US005647331A

United States Patent [19]

Swanson

[11] Patent Number: 5,647,331

[45] Date of Patent: Jul. 15, 1997

[54] LIQUID COOLED FUEL PUMP AND VAPOR SEPARATOR

[75] Inventor: Mark S. Swanson, Cass City, Mich.

[73] Assignee: Walbro Corporation, Cass City, Mich.

[21] Appl. No.: 699,790

[22] Filed: Aug. 19, 1996

Related U.S. Application Data

[60] Provisional application No. 60/003,583, Sep. 12, 1995.

[51] Int. Cl. [6] ..... F02M 37/04

[52] U.S. Cl. ..... 123/516; 123/509

[58] Field of Search ..... 123/509, 516, 123/518, 541, 41.31

[56] References Cited

U.S. PATENT DOCUMENTS

| | | | |
|---|---|---|---|
| 4,697,995 | 10/1987 | Tuckey | 418/15 |
| 5,103,793 | 4/1992 | Riese et al. | 123/516 |
| 5,257,916 | 11/1993 | Tuckey | 417/3 |
| 5,309,885 | 5/1994 | Rawlings et al. | 123/516 |
| 5,375,578 | 12/1994 | Kato et al. | 123/516 |
| 5,389,245 | 2/1995 | Jaeger et al. | 123/516 |

*Primary Examiner*—Thomas N. Moulis
*Attorney, Agent, or Firm*—Barnes, Kisselle, Raisch, Choate, Whittemore & Hulbert

[57] ABSTRACT

An electric fuel pump is housed in an aluminum body module formed by two iso-pods open-end-to-open-end to provide a multi-cavity module housing of heat conductive material. The pump inlet faces downwardly in one of the cavities and a small clearance volume directly surrounds the pump casing which, in one embodiment, is filled with liquid fuel and in another with cooling water. Another module cavity forms a fuel sump at its lower end and a vapor separator chamber at its upper end. Fuel is supplied from a fuel tank at a low pressure (3–8 psi) up to a float operated inlet needle valve in the vapor separator/sump cavity and a fuel passage communicates the sump with the pump inlet casing. The fuel collects as a pump inlet reserve supply in the sump at atmospheric pressure, or slightly thereabove. Vapor separates from the fuel into the pump headspace and is vented via a suitable vapor pressure regulator. The module has a water jacket coolant passageway system sealed from the housing cavities and surrounding the pump cavity so that circulation of cooling water through the housing water jacket carries away heat transferred to the housing from the fuel and generated by operation of the fuel pump. In a marine application the fresh or sea water boat intake for the engine cooling water is connected in series with the module coolant passageway on the intake side of the engine cooling system. Alternatively or supplementally, the module can be forced air cooled and/or the coolant liquid recirculated through a suitable heat exchanger such as a vehicle radiator for reuse in module cooling. In operation, the module reduces pump vapor lock by cooling incoming fuel, separating vapor therefrom and reducing sump operating temperature.

13 Claims, 6 Drawing Sheets

LIQUID COOLED FUEL PUMP AND VAPOR SEPARATOR

CO-PENDENCY OF PRIOR APPLICATIONS

This application claims the benefit under 35 U.S.C. §119 (e)(1) of U.S. Provisional application Ser. No. 60/003,583, filed Sep. 12, 1995.

FIELD OF THE INVENTION

This invention relates to fuel delivery systems for internal combustion engines, and more particularly to a liquid cooled fuel pump and vapor separator for use with water cooled internal combustion engines.

In fuel delivery systems for internal combustion engines that employ an electric motor driven fuel pump for pumping highly volatile liquid fuel, such as gasoline, from a fuel tank to the engine intake manifold, particularly where the fuel must be pressurized from 30 to 60 psi for delivery to engine fuel injectors, there remains the usual longstanding problem of vapor lock of the pump when the fuel being delivered to the pump is at elevated temperatures due to high ambient temperature conditions and/or heat generated by the electric motor of the pump. In addition in many engine fuel system applications adapted for both land vehicle and watercraft use the system is subject to substantial vibrational forces, that further induce vapor separation from the liquid fuel.

In many fuel systems fuel is returned to the fuel tank to reduce this problem. However, due to coast guard recommendations, fuel cannot be returned to the fuel tank. Therefore, any heat input from the engine to the fuel returned from the fuel injectors will be returned into a vapor separator that is mounted on the engine. This will increase the temperature of the fuel at the fuel pump inlet, thereby making vapor lock more pronounced.

OBJECTS OF THE INVENTION

Accordingly, it is an object of the present invention to provide an improved liquid cooled fuel pump, liquid fuel reservoir and vapor separator module incorporating a liquid-to-liquid heat exchanger for the electric fuel pump and reservoir of the module for cooling both incoming tank fuel being fed to the pump and the electric motor and fuel pump contained in the module to thereby inhibit development of pump vapor lock conditions, to provide a fuel sump for collecting a reserve supply of liquid fuel in the module for delivery to the pump inlet, which is also cooled by the aforementioned heat exchange, to provide for separation of vapor from the sump fuel prior to entry to the pump with the vapor being returned to the engine intake manifold, to thereby further inhibit pump vapor lock, and to provide such an module which is economical to manufacture, rugged and reliable in use, which is compatible with a pump outlet bypass pressure regulator incorporated in the module and which has a long and useful service life.

SUMMARY OF THE INVENTION

In general, and by way of summary description and not by way of limitation, the invention achieves the aforementioned objects by housing a standard electric fuel pump in an aluminum body module formed by two iso-pods joined open-end-to-open-end to provide a multi-cavity housing of heat conductive material. Preferably the housing has two side-by-side cavities with their major axes oriented vertically in use. The fuel pump is installed inlet end down in one of the cavities and communicates with the pump inlet at the bottom of this cavity. A clearance volume surrounds the pump casing which in one embodiment contains liquid fuel and in another embodiment contains cooling water. The other housing cavity forms a fuel sump at its lower end and a vapor separator chamber at its upper end.

Fuel is supplied to the vapor separator/sump cavity pulse from a fuel tank at low pressure (3–8 psi) and enters via a float operated inlet needle valve provided in the vapor separator/sump cavity. The fuel collects as a reserve supply within this float reservoir and the sump headspace is maintained at atmospheric pressure, or slightly thereabove. Vapor separating from the liquid fuel in the sump into the sump headspace is vented therefrom through a vent passageway controlled by a suitable vapor pressure regulator, this vapor preferably being conducted by a vent conduit to the engine intake manifold. An internal casing cross passage connects the bottom of the sump with the pump cavity in the vicinity of the pump inlet. Incoming fuel thus contacts both the fuel pump body and the vapor sump reservoir housing, and in one embodiment, the fuel surrounding the pump assists heat transfer from pump to the housing.

The module housing is also provided with a water coolant passageway system sealed from the housing fuel containing cavities and surrounding the pump cavity. This coolant passageway system is connected to coolant inlet and outlets of the housing for circulation of cooling water through the housing to thereby carry away heat transferred to the housing either by transfer from the fuel in the module and/or by direct immersion of the pump in the coolant. In a marine engine application the fresh or sea water boat intake normally provided for the engine cooling water is connected in series with the module coolant passageway so as to circulate this cold water therethrough on its way to the inlet of the engine cooling system, and which in turn typically discharges engine cooling water into the boat exhaust system. Alternatively, the module coolant liquid can be recirculated through a suitable heat exchanger, such as a radiator for reuse in the module cooling system.

In operation the module reduces the pump outlet fuel temperature to a temperature only slightly above that of the liquid coolant in the module. Fuel cooling can be further enhanced for providing the module with external heat radiating fins to further disperse heat from the unit either when the module is located internally or externally of the fuel tank, and preferably remote from the engine in either event. Preferably, the module is located in a cooling stream between and remote from both the tank and engine.

BRIEF DESCRIPTION OF THE DRAWING

The foregoing as well as other objects, features and advantages of the present invention will be apparent from the following detailed description of a presently preferred embodiment and the best mode presently known of making and using the invention, from the appended claims and from the accompanying drawings (which are to scale unless otherwise indicated) in which:

DETAILED DESCRIPTION OF PREFERRED EMBODIMENT

Figure 1:
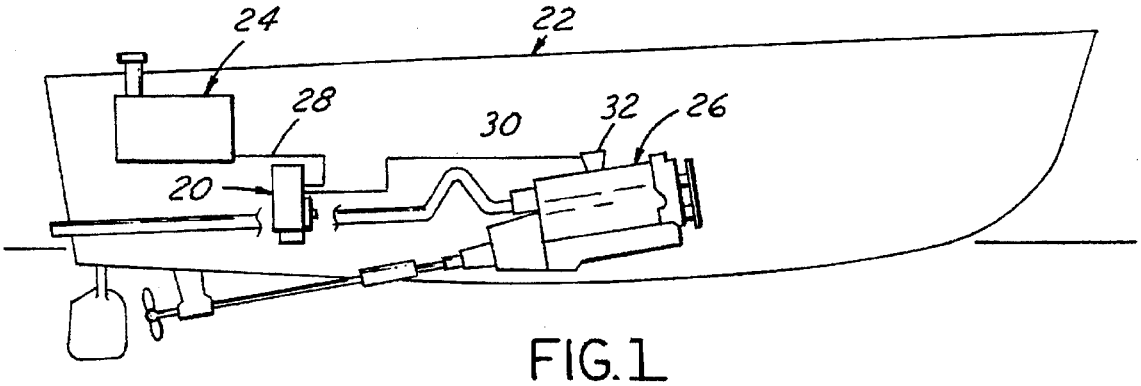
FIG. 1 is a simplified semi-diagrammatic illustration of a first embodiment of a liquid cooled fuel pump and vapor separator module as installed in a boat of the inboard-engine, single screw type and operably connected to deliver fuel between the fuel tank and boat engine.

Referring in more detail to the accompanying drawings, FIG. 1 illustrates in simplified semi-diagrammatic form marine application of a first embodiment of a liquid cooled fuel pump and vapor separator unit 20 of the invention in the form of an externally installed module mounted in the hull of a single screw power boat 22 for delivering liquid fuel from a fuel tank 24 of the boat to the fuel injectors of an inboard internal combustion marine engine 26 of the boat. Unit 20 is shown in conjunction with a "no-return" type fuel delivery system between and remote from tank 24 and engine 26 and is operable to receive low pressure liquid fuel e.g., gasoline, from tank 24 via a fuel feed line 28 connected between tank 24 and the fuel inlet 90 (FIGS. 4, 4A and 12) of unit 20. Unit 20 is operable to feed high pressure liquid fuel via a fuel delivery line 30 connected at its inlet to a fuel outlet 66 (FIG. 3) of unit 20 and connected at its downstream outlet to a conventional fuel rail 32 feeding conventional fuel injectors of engine 26. A standard diaphragm operated fuel pump (not shown) is mounted on engine 26 and is operably coupled between tank 24 and line 28 to pump tank fuel under low pressure (e.g., 3–8 psi) via line 28 to the inlet of unit 20.

As shown in more detail in FIGS. 2–14, unit 20 comprises an aluminum die cast iso-pod type multi-cavity housing made of an upper casing 40 and a lower casing 42 fastened together at the mid-plane of the housing by a peripheral array of machine screws or bolts 44, 46. Casings 40 and 42 are generally die-cast aluminum hollow half shells formed with chambers and passages opening at their mutually facing ends and closed at the axially opposite ends to provide a sealed iso-pod housing as assembled in FIGS. 2–14. Suitable O-ring seals 48, 50, 52 are provided in grooves in the upper face of the lower casing part 42 and clamped by the facing edge of upper casing 40 in assembly of unit 20.

Unit 20 includes a high pressure fuel pump 54 which is preferably a commercially available in-tank fuel pump as manufactured and sold by the Walbro Corporation, assignee of record herein. Pump 54 may be either a turbine type pump or a positive displacement type pump. A suitable positive displacement gear rotor type fuel pump is disclosed in U.S. Pat. No. 4,697,995, and a suitable turbine regenerative fuel pump is disclosed in U.S. Pat. No. 5,257,216, the disclosures of which are incorporated herein by reference, and hence pump 54 will not be described in further detail.

Figure 2:
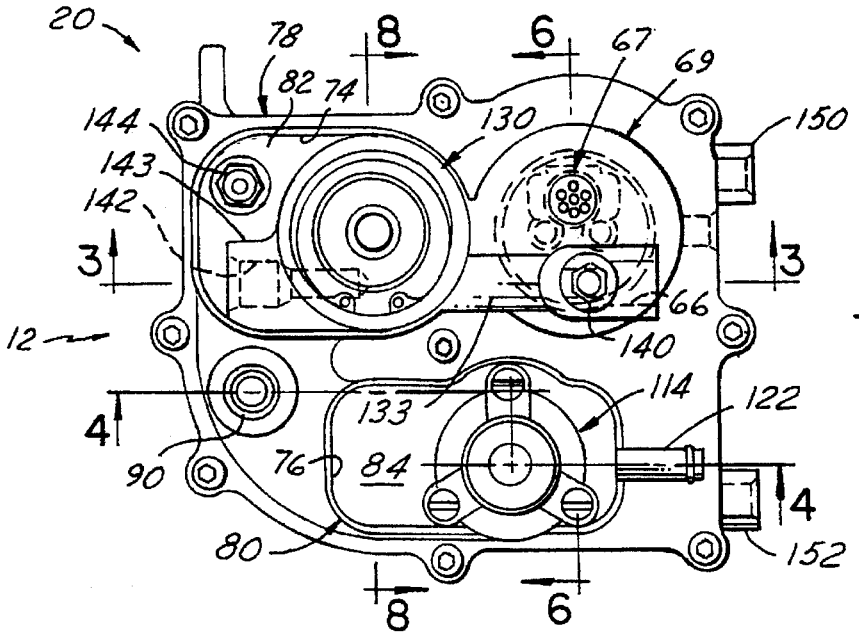
FIG. 2 is a top plan view of the liquid cooled fuel pump and vapor separator unit shown by itself.
Figure 6:
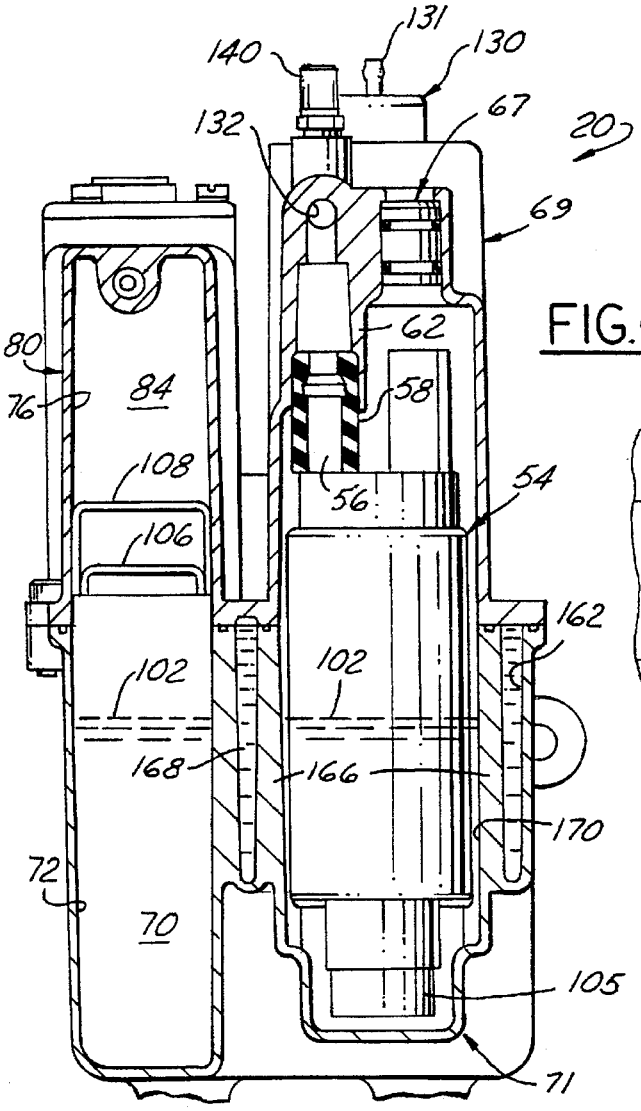
FIG. 6 is a vertical cross-sectional view taken on the line 6—6 of FIG. 2.
Figure 10:
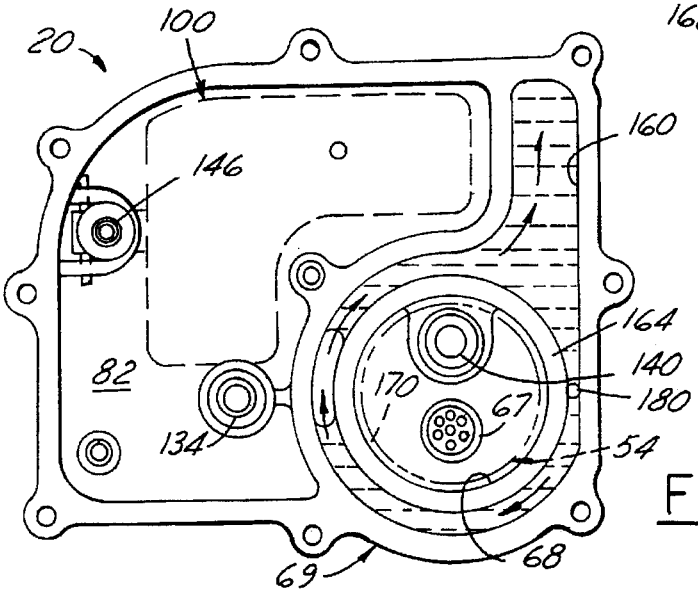
FIG. 10 is a horizontal cross-sectional view taken on the line 10—10 of FIG. 3.
Figure 11:
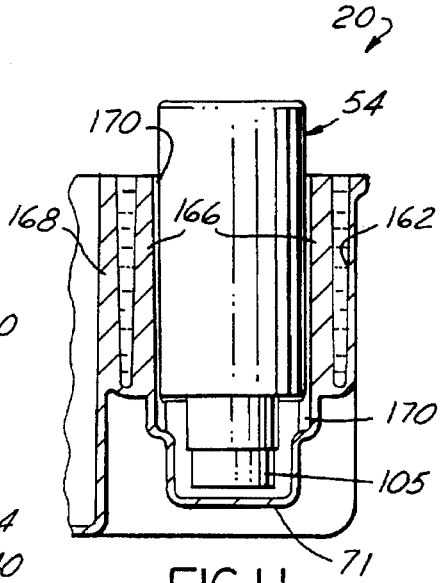
FIG. 11 is a fragmentary vertical cross-sectional view taken on the line 11—11 of FIG. 5.

In the illustrative embodiment of unit 20 an outlet nipple 56 of pump 54 is coupled by a resilient sleeve 58 to the bore 60 of a hollow casing boss 62 which, via a connecting passage 64, communicates with the threaded inlet coupling fitting (not shown) of fuel line 30 threadably received in the threaded passage of outlet 66 of upper casing 40. As best seen in FIGS. 2, 6 and 10, a conventional hermatically sealed electrical terminal connector fitting 67 is provided in the upper end of pump housing 69 for coupling external power and control leads to internal motor power and control leads. Pump 54 is received with a relatively large side clearance in a cylindrical cavity bore 68 conjointly formed by a pump housing portion 69 of upper casing part 40 and a pump housing portion 71 of lower casing part 42. The portion of bore 68 that is formed in housing portion 71 of lower casing 42 has at least three circumferentially spaced and axially extending and radially inwardly protruding mounting ribs (not shown) for telescopingly receiving the casing of pump 54 with a press fit in the ribs to thereby mount pump 54 for suspension in bore 68 with a surrounding radial clearance space 170 shown in FIGS. 3 and 6.

Unit 20 also has a kidney-shaped fuel well or sump chamber 70 (FIG. 5) formed by a cup-like cavity 72 in lower casing 42. As best seen in FIGS. 2, 3, 4, 6, 8 and 9, cavity 72 communicates at its upper open end with the open lower ends of a vapor separator cavity 74 and a fuel return chamber cavity 76 respectively provided in side-by-side towers 78 and 80 formed on upper casing part 40. Cavity 74 defines a fuel return and vapor separator chamber 82 and cavity 76 defines a vapor separator and vapor outlet chamber 84.

Liquid fuel is supplied to fuel sump 70 of unit 20 via tank feed line 28 which is coupled at its outlet end to a hose nipple 90 (FIGS. 4 and 4A) of an inlet fitting 91 threadably mounted in an interior boss 92 of upper casing 40. Fuel is admired to sump 70 under the control of an inlet needle valve 94 operated through a lever arm 96 pivoted by a pin 98 on the lower end of boss 92 (FIG. 4A). Lever arm 96 is fixed at its pin-remote end to a kidney-shaped float 100 which maintains needle valve 94 closed when the fuel level 102 reaches the elevation shown in FIGS. 3, 4, 8 and 12. As fuel is withdrawn from the lower reaches of sump 70 via a casing interior cross passage 104 (FIG. 3) by pump suction to the inlet fitting 105 of pump 54, float 100 will drop accordingly to allow needle valve 94 to open to replenish fuel to sump 70 to maintain the fuel level 102 generally at the elevation illustrated in FIG. 3.

In accordance with one feature of the invention, upper casing tower 80 provides for sump vapor collection in chamber 84 which is open at its lower end to the head space of sump 70 in lower casing 42. If desired, a pair of suitable perforated, kidney-shaped splash baffles 106 and 108 may be mounted in the lower ends of cavities 82 and 84 to serve as perforate covers over sump 70 to impede upward splashing of liquid fuel from sump 70 into chambers 82 and 84.

Figure 4A:
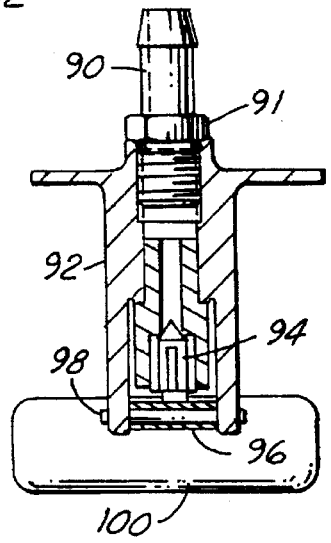
FIG. 4A is a fragmentary cross-sectional view taken on the line 4A—4A of FIG. 4.
Figure 4:
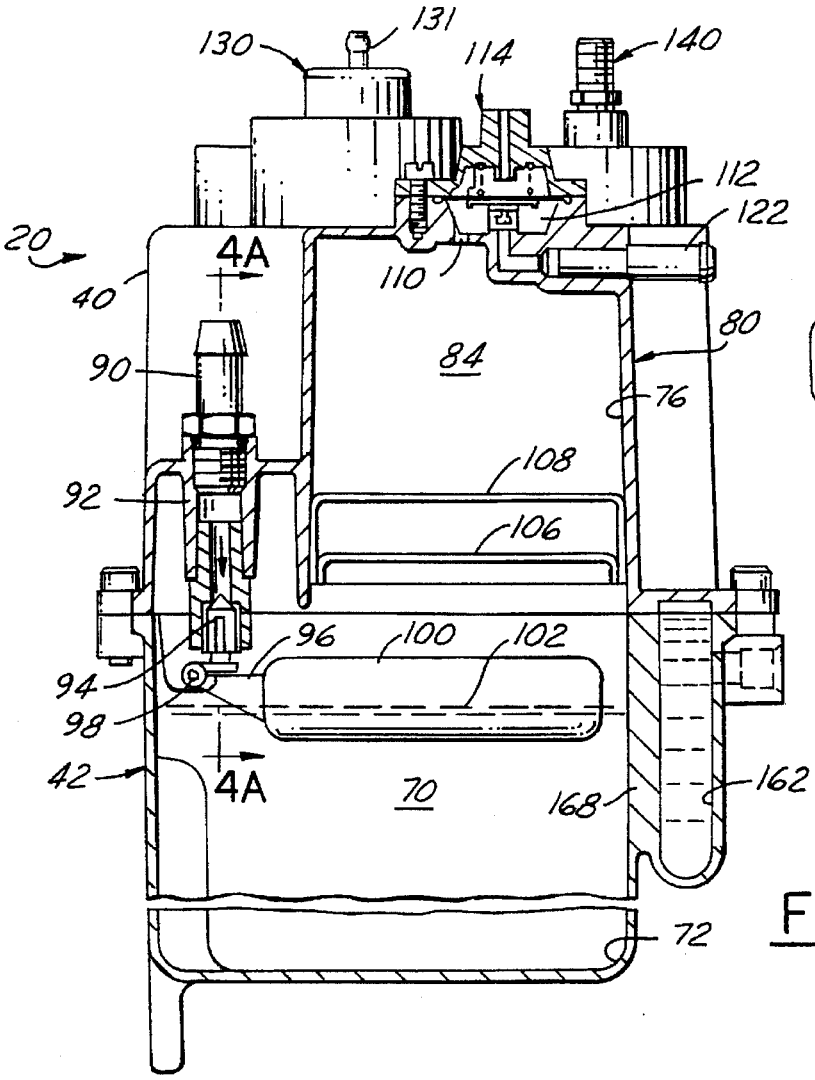
Figure 5:
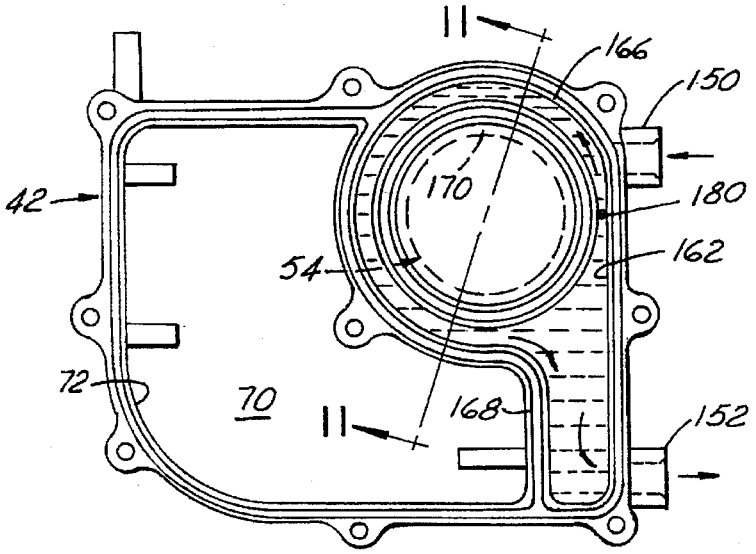
FIG. 5 is a horizontal cross-sectional view taken on the line 5—5 of FIG. 3.
Figure 7:
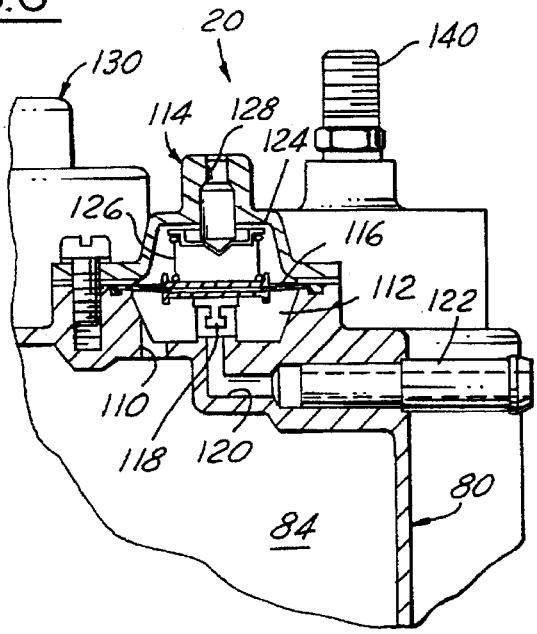
FIG. 7 is a fragmentary enlarged view of the upper right hand portion of FIG. 4 illustrating in greater detail the vapor pressure regulator associated with the vapor dome of the unit.

The upper end of chamber 84 communicates via a passage 110 with the regulating chamber 112 of a conventional diaphragm-type vapor pressure regulator unit 114 mounted on the upper end of tower 80 (FIGS. 4 and 7). A diaphragm 116 carries a valve 118 which opens and closes a vent passage 120 in turn coupled by an outlet hose nipple 122 to a suitable fuel vapor vent line typically leading to an intake port in the intake manifold of engine 26. The upper diaphragm chamber 124 of regulator 114 contains a spring 126 for biasing diaphragm 116 and associated valve 118 towards closed position, and chamber 124 is coupled by a vent 128 to ambient atmosphere.

Figure 3:
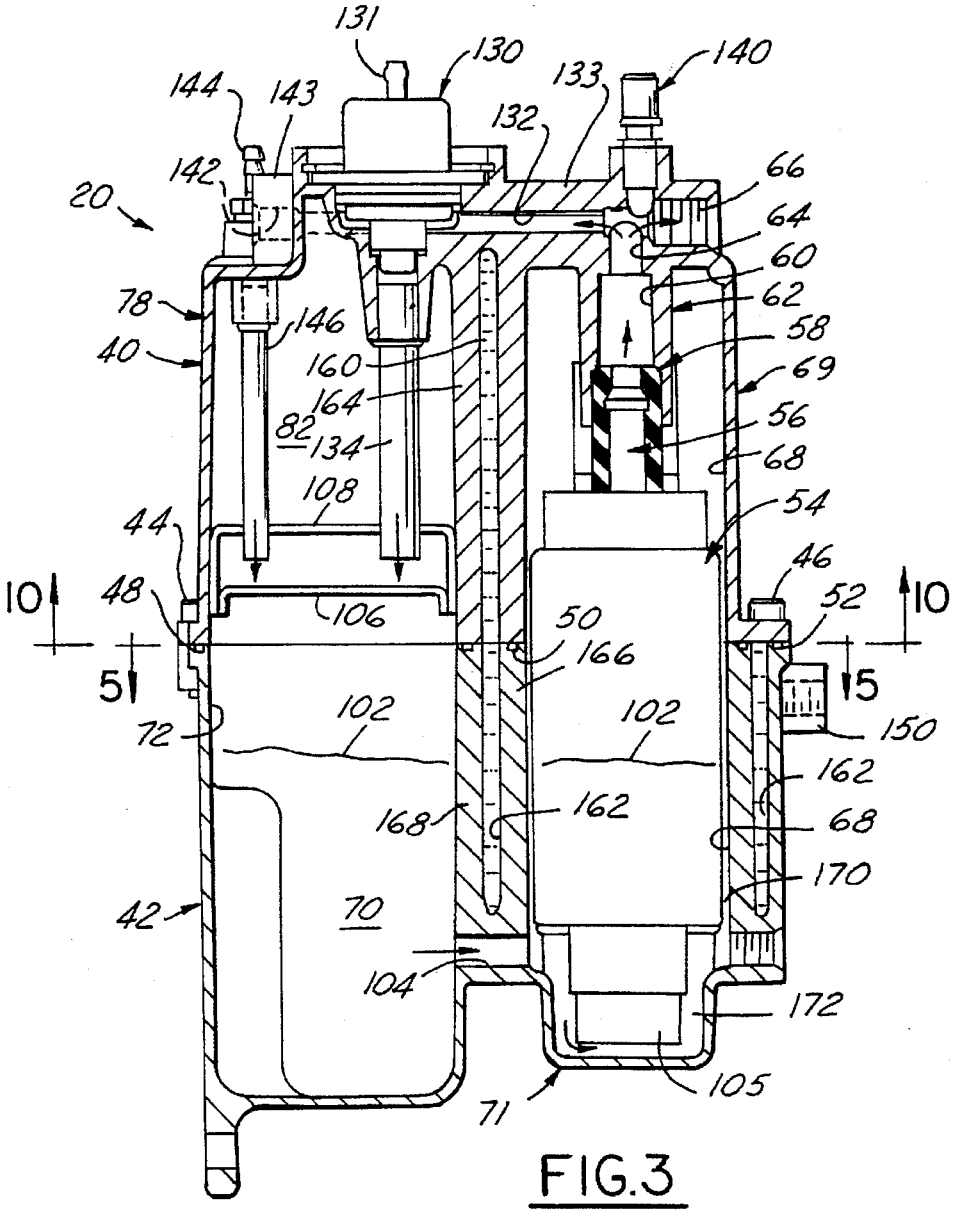
FIGS. 3 and 4 are vertical cross-sectional views taken respectively on the lines 3—3 and 4—4 of FIG. 2.
Figure 8:
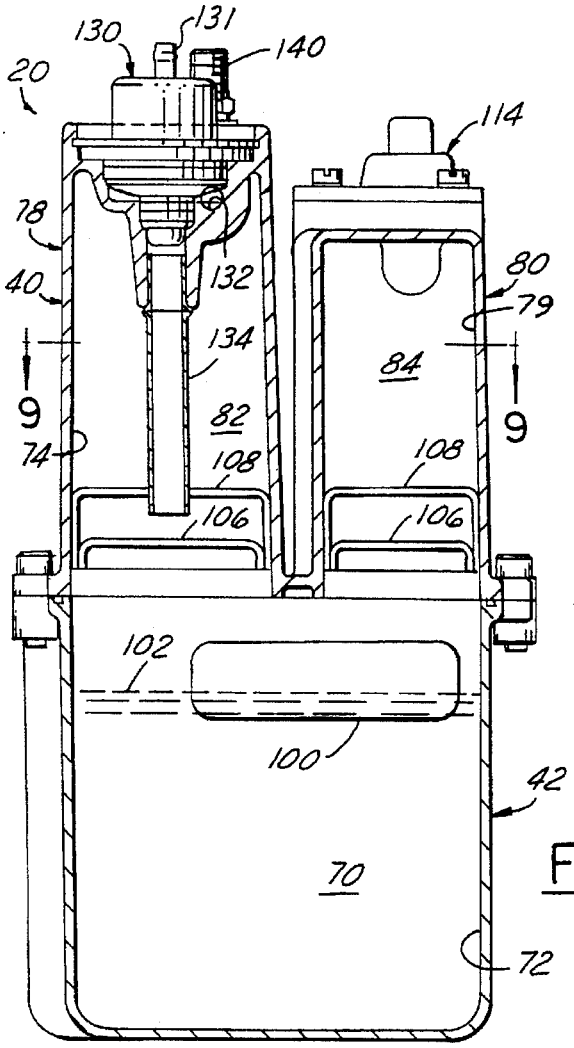
FIG. 8 is a vertical cross-sectional view taken on the line 8—8 of FIG. 2.
Figure 9:
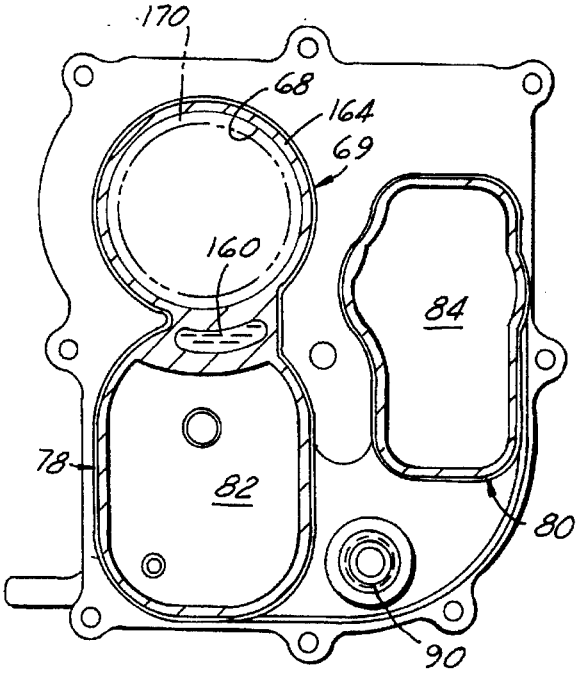
FIG. 9 is a horizontal cross-sectional view taken on the line 9—9 of FIG. 8.

As best seen in FIGS. 2, 3 and 8 the companion upper casing tower 78 has mounted on its upper end a conventional diaphragm-operated fuel by-pass type pressure regulator 130 having its inlet communicated (in the case of a no-return systems) by a cross passage 132 to the outlet passage 64 from pump 54. Unit 20 is then operable in the manner of a "no-return" type fuel delivery system to thereby provide pressure regulation of fuel in delivery line 30 by engine by-pass of pump fuel output flowing via by-pass passage 132 through regulator 130 and into an interior by-pass return tube 134 extending downwardly in chamber 82 (FIGS. 3 and 8). The lower end of tube 134 protrudes through the U-shaped perforate baffle separator 108 and terminates above separator 106. By-passed fuel is thus discharged from pressure regulator 30 downwardly directly into reservoir sump 70 in casing 42 without leaving unit 20.

In normal operation of such by-pass fuel delivery system, pump 54 supplies a greater quantity of fuel to pressure regulator 130 than is needed to meet the operational demand of operating engine 26. Regulator 130 maintains a substantially constant pressure of fuel supplied through the fuel delivery line 30 to the fuel rail 32 of engine 26, and by-passes or discharges excess fuel through its outlet tube 134 into the reservoir sump 70. Typically the pressure regulator will maintain a substantially constant output pressure in line 30, such as 50 psi, with a pressure drop of about 1 psi over the full range of variation of the fuel flow rate to the engine from say 0 to 40 gallons per hour. Regulator 130 has a nipple 131 for connecting its spring/diaphragm regulating chamber with either ambient atmosphere, the engine intake manifold or engine exhaust manifold. Suitable pressure regulators for such no-return fuel systems are disclosed in U.S. Pat. No. 5,220,941 and 5,398,655, the disclosures of which are incorporated herein by reference and not described in greater detail.

A Schrader valve 140 may also be mounted to the top of casing 40 for checking pump outlet pressure and for bleeding the system lines after a dormant period (e.g., winter lay up of boat 22).

In accordance with another feature of the invention, unit 20 is also readily converted for use in a "return-type" fuel delivery system wherein by-pass return fuel is fed from fuel rail 32 through a suitable return line (not shown) to a fuel return inlet passageway 142 (FIGS. 2 and 12) machined in a boss 143 at the upper end of tower 78. Passageway 142 feeds fuel from the fuel return line outlet into the regulating valve chamber of regulator 130 for discharge therefrom via tube 134 into sump 70. When unit 20 is so converted, passageway 132 through cross boss 133 is omitted.

Figure 12:
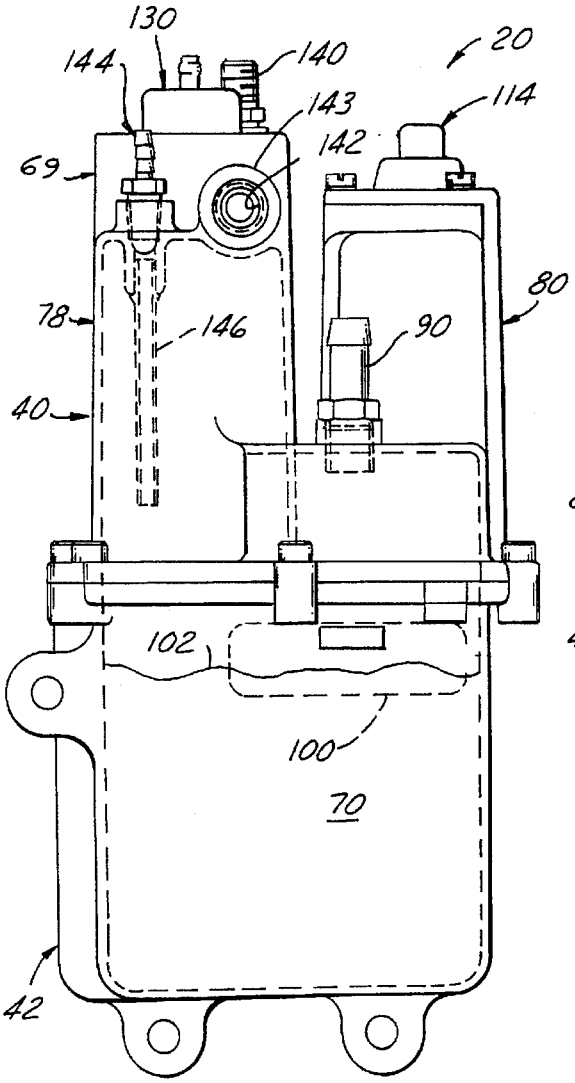
FIGS. 12 and 13 are vertical side elevational views of the module respectively looking in the direction of the arrows 12 and 13 of FIG. 2.
Figure 13:
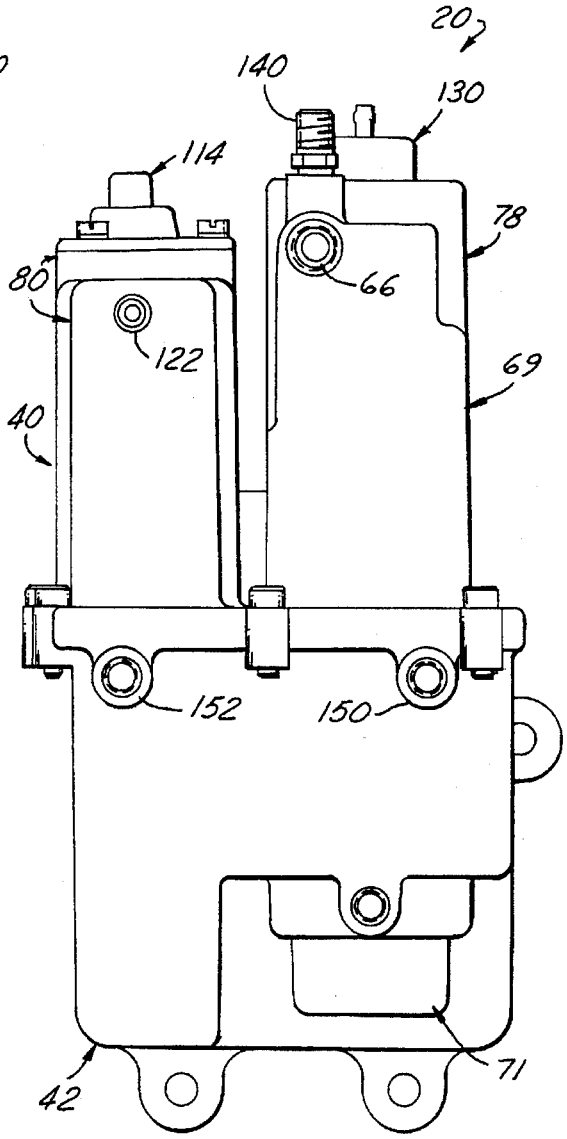
Figure 14:
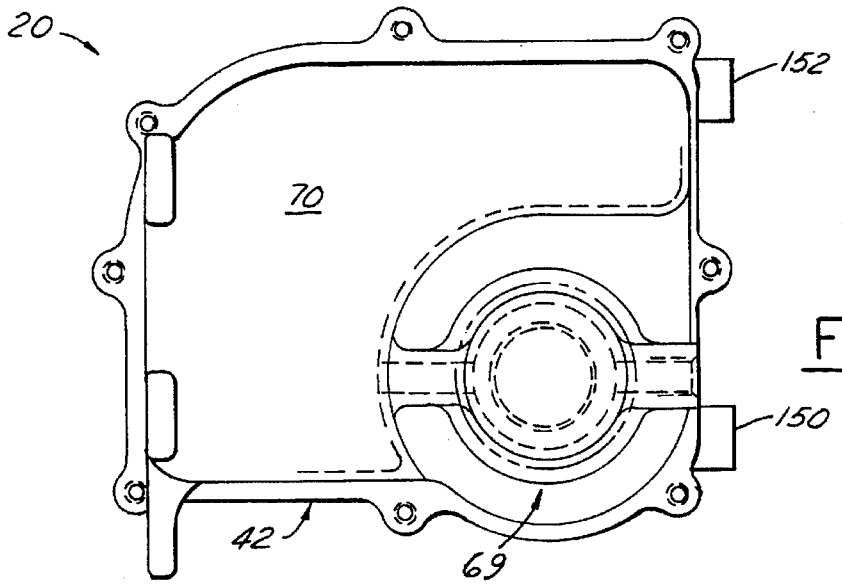
FIG. 14 is a bottom plan view of the module.

As best seen in FIGS. 2, 10 and 12, unit 20 also has a hose nipple 144 communicating with an oil drain return tube 146 extending downwardly in vapor chamber 82, through baffle 108, and opening above baffle 106 for returning oil or a fuel and oil mixture from the crankcase of engine 26 in the case of a two-stroke cycle engine using an oil-gasoline fuel mix.

In accordance with another and principal feature of the invention, unit 20 is liquid cooled by utilizing fresh intake cooling water supplied from an existing conventional on-board engine water cooling system as typically provided in boat 22. The cooling water feed and return conduits (not shown) for intercoupling the water cooling passageways of unit 20 serially into the intake side of this on-board engine water cooling system are suitably coupled by threaded end fittings (not shown) to lower casing part 42 via inlet and outlet threaded port bosses 150 and 152 respectively (FIGS. 2, 3, 5 and 13). As best seen in FIGS. 3, 5, 6, 9, 10 and 11, the upper and lower casings 40 and 42 are each provided with water cooling passageways in the form of circulation chambers 160 and 162 respectively which in this first embodiment only encircle the outer surfaces of walls 164 and 166 of the pump housing 69. The interior surfaces of walls 164 and 166 define the pump cavity 68 in the upper and lower casings 40 and 42. The configuration of the water cooling chambers 160 and 162 is shown to scale in FIGS. 3, 4, 5, 6, 9 and 10. It will be seen that this conjoint water cooling chamber circulates intake fresh or sea cold water around wall 166 on its outer side, and such cooling water is also in contact with the side wall 168 of lower casing 42 forming the one side surface of the fuel sump 70. The cooling water is shown by broken dash lines in the casing cooling chambers in these views. As shown by the flow arrows in FIGS. 5 and 10, incoming cold water from casing inlet 150 flows in channels 160 and 162 around and adjacent the pump housing walls 164 and 166 in the arrow flow path and exits channels 160 and 162 at casing outlet 152. A dam pin or fib 180 is provided in channels 160 and 162 between the pump housing wall and the surrounding casing exterior wall defining such channels to prevent short circuiting flow of cooling water between inlet 150 and outlet 152.

From the foregoing description, it will now be seen that in operation and use of the first embodiment of a liquid (water) cooled fuel pump and vapor separator unit 20 of the invention, a standard electric fuel pump 54 is housed in a highly heat conductive aluminum body by two iso-pod casings 40 and 42. The small clearance volume space 170 in the pump housing (FIGS. 3, 11 and 6) directly surrounds the body of fuel pump 54 and is filled to level 102 with liquid fuel from sump 70 within the lower casing part 42.

In operation, liquid fuel is supplied to unit 20 down through the sump head space to collect in the liquid fuel sump 70 of the vapor separator portion of the casing by the aforementioned engine crankcase pulse-driven diaphragm pump mounted on engine 26 (not shown). This engine pump operates to draw liquid fuel from tank 24 and slightly pressurize (3–8 psi) this fuel for supply via fuel line 28 to the inlet needle valve 94 of the vapor separator. After passing through the inlet needle valve 94, the liquid fuel resides within the float reservoir 70 at atmospheric pressure or slightly thereabove. Fuel pump 54 is preferably mounted such that its inlet fitting 105 (containing a conventional fuel filter element) is directed downwardly into its own chamber well 172 at the bottom of pump housing 71 of casing part 42. Liquid fuel is able to pass from sump 70 through casing passage 104 into chamber 172 and up around the clearance space 170 surrounding the casing of pump 54 to thereby bath the exterior of the lower end of pump 54 with such liquid fuel. Liquid fuel in sump 70 also contacts and flows against the heat conductive casing walls, such as wall 168 of casing 42 partially defining fuel reservoir sump 70. Thus liquid fuel is able to absorb heat from the pump and retransmit it both to the ambient air cooled aluminum exterior walls of lower casing part 42 and to the interior water cooled pump housing walls.

Although the casing water cooling channels 160 and 162 are isolated from the fuel chambers and fuel passageways in this first embodiment by the aluminum walls of casing parts 40 and 42, these channels are in close heat exchange proximity through these heat conductive casing walls with the outside of the pump housing clearance volume 170 containing the liquid fuel. The liquid cooling water thus can carry away heat transmitted through the aluminum walls of the casing that was transferred to the vapor reservoir and from around the pump casing by the liquid fuel, as well as by radiation into the casing walls from the pump. This cooling liquid, preferably from the fresh or sea water intake of boat 22, can be either disposed of by discharge into the engine cooling system as described hereinabove, or cooled and recirculated into unit 20 by an on-board conventional heat exchanger system installed on boat 22 (not shown).

It thus will be seen that the invention provides a fuel delivery system with a compact unit 20 providing built-in fuel pump and associated fuel vapor separator to both cool the pump as well as the liquid fuel contained in the unit with a built-in liquid coolant system. Unit 20 is thus operable to reduce the quantity of fuel vapor generated above the liquid fuel level 102 in the head space of the reservoir 70 and in the vapor domes 82 and 84 communicating with one another via the reservoir head space. If desired, the vapor pressure regulator 114 may be set to maintain a slightly super-atmospheric pressure in vapor chambers 82, 84 and in the head space of sump 70 to help force fuel toward pump 54. However, as vapor pressure build up above such pressure levels occurs in the vapor separator chamber 84 from accumulated fuel vapor and/or air separating from sump 70, the same is vented via vent 122 through the pressure regulator 114. The vapor separator chamber, in conjunction with the liquid cooling system of unit 20, thus operate to eliminate or greatly reduce vapor lock of pump 54 during operation thereof when running to supply fuel to engine 26 and/or by-pass fuel from the pump back to the vapor separator chambers of unit 20.

Unit 20 is also operable in the manner of an in-tank fuel canister often employed in fuel delivery systems for fuel-injector-equipped engines, i.e., sump 70 contains a reserve quantity of fuel so pump inlet 105 is not momentarily starved by the effects of adverse bodily shaping of the tank fuel or by adverse orientation of tank 24 during operation of boat 22, which may cause intermittent fuel starving of the in-tank inlet of fuel line 28 in tank 24.

In a marine application the module unit 20 can take advantage of an unlimited supply of fresh or sea cooling water normally ingested by a boat scupper intake to the engine water pump for circulation through the engine cooling system and then discharged back to the surrounding body of water through the engine exhaust. This relatively low temperature water coolant passing through the unit 20 on the intake side of the engine water cooling system can provide a marked reduction in temperature of the liquid fuel supply delivered to the engine fuel intake system. For example, in one test a reduction of 70° F. was achieved in the pump outlet fuel temperature when providing a non-recirculated water supply at a temperature of approximately 57° F. thereby indicating a possible 13° F. temperature difference between the cooling water supply and the pump outlet fuel temperature.

In land vehicle applications the module inlet and outlets can be serially connected in the discharge side of the engine cooling radiator for heat transfer from the module to this radiator cooled water prior to its passage to the intake of the engine cooling system. In addition, the unit, being made of die cast aluminum, can be readily provided with suitable cooling fins (not shown) and installed in a location remote from the engine and close to a favorable air cooling source, e.g., for example being close to the vicinity to the engine radiator fan or, in a marine application, close to the outlet of an ambient air intake vent blower to further enhance reduction in pump outlet fuel temperature.

From the foregoing, it will now be understood that the liquid cooled fuel pump, reservoir and vapor separator module of the invention efficiently accomplishes a marked reduction of fuel temperature both within the module sump and in the module pump that greatly inhibits the tendency for the fuel to vaporize, thereby reducing vapor lock problems in both the fuel pump and in the fuel delivery system to the fuel injectors of the engine.

Figure 15:
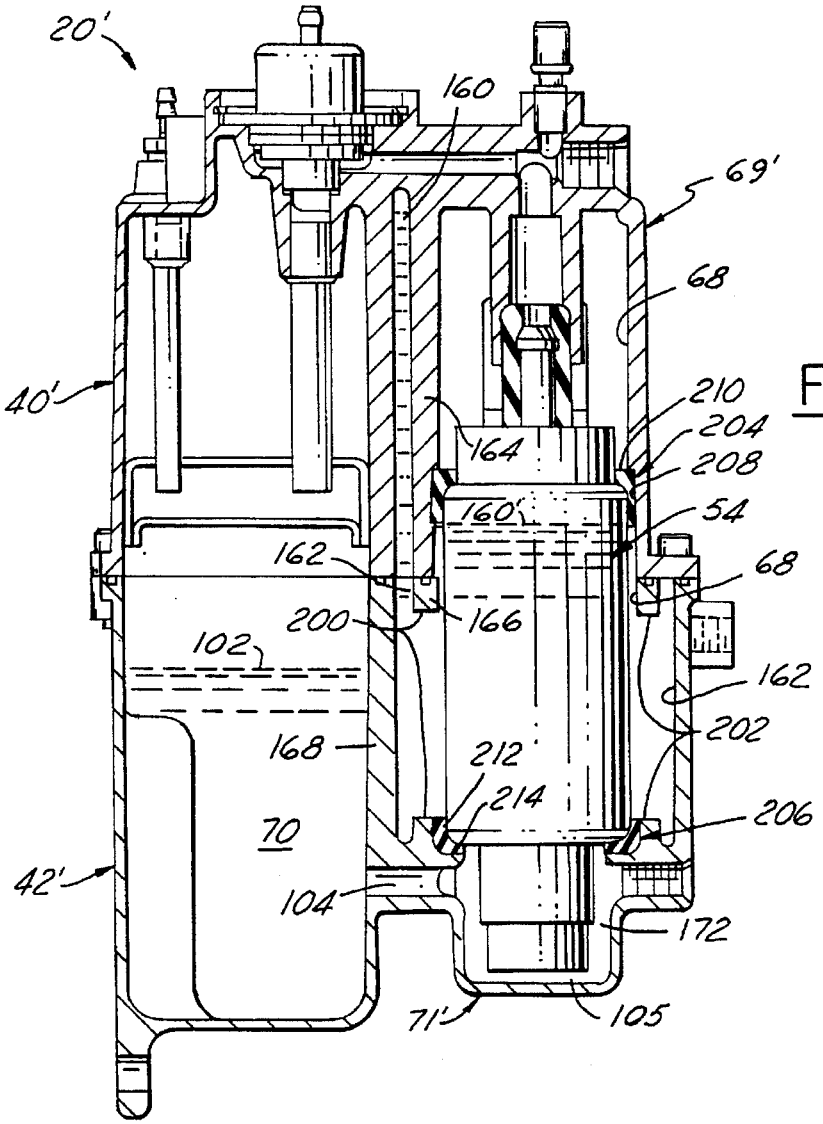
FIG. 15 is a view similar to FIG. 3 illustrating a second embodiment of the module of the invention.

FIG. 15 illustrates a second embodiment of a module 20' of the invention wherein elements identical to those previously described are given like reference numerals, and wherein slightly modified elements are given like reference numerals having a prime suffix, and the description of such elements is not repeated. It thus will be seen that module 20'0 is similar to module 20 except that the mast of the exterior surface of the casing of pump 54 is directly immersed in the cooling water, rather than in the fuel being fed to the pump inlet, as in module 20, wherein the pump is separated from cooling water by the fuel in clearance space 170 and by the cooling passageway water jacket walls.

To accomplish this exemplary modification, a circumferentially spaced annular row of a plurality of vertically elongated large area flow openings, two of such openings 200 and 202 being seen in FIG. 15, are provided in wall 166 of pump housing 71 of lower casing port 42, the cooling water passageway system of module 20' thus now additionally includes the annular clearance volume channel 160' directly exposed to and surrounding volume mast of the axial extent of the pump casing. Channel 160' is sealed at its upper and lower ends by suitable resilient sealing grommets 204 and 206 respectively encircling the upper and lower ends of the major diameter main body portion of the casing of pump 54, that portion of bore 68 formed in upper casing part 40' has a counterbore 208 formed at its lower end to telescopically receive upper grommet 204 so as to seat against an annular stop shoulder 210. A similar counterbore 212 and associated shoulder 214 is provided in that portion of bore 68 formed in lower casing part 42' to thereby likewise receive and seat lower grommet 206. Hence, both the space above pump 54 and the fuel inlet chamber 172 below pump 54 are sealed off liquid tight from the cooling water chamber 160' by grommets 204 and 206. It will thus be seen from the construction illustrated by way of example in FIG. 15 that the heat exchange efficiency between pump 54 and the cooling water flow in module 20' is enhanced by the direct heat transfer contact of the cooling water in chamber 160' with a major portion of the exterior surface of the heat conductive metallic casing of pump 54.

What is claimed is:

1. A liquid cooled fuel pump and vapor separator module for supplying liquid fuel to an internal combustion engine comprising a heat conductive metal casing having (1) first casing cavity means containing an electric motor and pump unit and having a fuel pump inlet and a fuel pump outlet adapted to be connected to an engine fuel delivery system;

(2) second casing cavity means containing a fuel collecting sump having an outlet communicating with the pump inlet, said casing having fuel inlet means communicating with said sump and vapor chamber and adapted to be connected to an external source of liquid engine fuel;

(3) third casing cavity means containing a vapor collecting chamber disposed above the fuel level in the sump and communicating therewith, and vapor venting means for venting vapor collected in said vapor collecting chamber to the exterior of said casing; and (4) liquid coolant conducting passageway means in said casing constructed and arranged in generally surrounding heat exchange relationship with at least said first cavity means and adapted to be circulation connected with a liquid coolant external supply source.

2. The module set forth in claim 1 wherein said casing is constructed as a two-piece iso-pod constructed to have its major axis oriented vertically in use having upper and lower casing parts adjoined generally at mid-elevation to form said iso-pod, said lower casing part containing said second cavity means and a pump inlet end portion of said first cavity means, said upper casing part containing said third cavity means and a pump outlet portion of said first cavity means.

3. The module set forth in claim 2 wherein said coolant passageway means surrounds said pump inlet and portion of said first cavity means.

4. The module set forth in claim 2 wherein said second cavity means has at least a portion thereof adjacent said coolant passageway means and in heat conductive relationship therewith.

5. The module set forth in claim 4 wherein a float is disposed in said second cavity means and is operably coupled to control a fuel inlet valve constructed and arranged in said casing for controlling supply of fuel from said fuel inlet means to said sump for retention of fuel in said sump at or slightly above atmospheric pressure.

6. The module set forth in claim 2 wherein said sump outlet comprises a fuel passageway in said lower casing part connecting said sump with said pump inlet portion of said first cavity means.

7. The module set forth in claim 6 wherein said pump unit is received in said pump inlet portion of said casing means with a clearance space surrounding said pump unit and communicating with said sump outlet passageway, said casing being constructed and arranged such that the inlet end of said pump sump and pump is submerged in liquid fuel filling said clearance space to the elevation of fuel collected in said sump.

8. The module set forth in claim 1 in further combination with a water cooled marine internal combustion engine provided with a cooling fresh or sea water intake system for supplying such cooling water as coolant to the cooling system of said engine, said casing liquid cooling passageway means being connected in water flow series with the intake side of said engine cooling system.

9. The module set forth in claim 8 wherein said engine is a two-stroke cycle engine operable on a liquid fuel mixture of gasoline and lubricating oil and having a crankcase equipped with excess oil collecting means for draining excess oil from said crankcase, and wherein said unit has oil drain conduit means operably communicating with said engine oil drains and emptying into said second cavity means.

10. The module set forth in claim 1 wherein said unit has vapor conducting conduit means and a vapor pressure regulating valve means therein disposed in vapor communication with said third cavity means, said vapor conduit means being adapted to be connected downstream of said valve means with a vapor receiver such as an intake manifold of an engine.

11. The module set forth in claim 1 and wherein said unit has a liquid pressure regulating means constructed and arranged in said casing and coupled between said pump outlet and said third cavity means adapted for regulating pump output liquid pressure in said outlet by by-passing from an outlet of said liquid pressure regulating means to said third cavity means that portion of liquid fuel delivered by said pump in excess of fuel demand by an engine to be supplied with fuel by said unit.

12. The module set forth in claim 11 wherein said pressure regulating means outlet is located in said third cavity means for fuel discharge therefrom at an elevation above the level of fuel maintained in said sump of said second cavity means.

13. The module set forth in claim 1 wherein said liquid conducting passageway means includes a chamber constructed and arranged to directly immerse in the liquid coolant a major portion of said pump unit.

* * * * *

UNITED STATES PATENT AND TRADEMARK OFFICE

CERTIFICATE OF CORRECTION

PATENT NO. : 5,647,331

DATED : July 15, 1997

INVENTOR(S) : Mark S. Swanson

It is certified that error appears in the above-indentified patent and that said Letters Patent is hereby corrected as shown below:

In the ABSTRACT, line 15, change "pump headspace" to "sump headspace".

Col. 9, Line 8, after "use" insert "and".

Col.9, Line 17, after "inlet" delete "and".

Signed and Sealed this

Second Day of December,1997

*Attest:*

Bruce Lehman

BRUCE LEHMAN

*Attesting Officer*

*Commissioner of Patents and Trademarks*